US009890439B2

(12) United States Patent
Arnold et al.

(10) Patent No.: US 9,890,439 B2
(45) Date of Patent: Feb. 13, 2018

(54) METHOD FOR CASTING CAST PARTS

(71) Applicant: Fritz Winter Eisengiesserei GmbH & Co. KG, Stadtallendorf (DE)

(72) Inventors: Klaus Arnold, Mandelbachtal (DE); Dirk Rogowski, Amoneburg (DE); Jürgen Schmidt, Colbe (DE); Rolf Süssmann, Homberg (DE)

(73) Assignee: Fritz Winter Eisengiesserei GmbH & Co. KG, Stadtallendorf (DE)

( * ) Notice: Subject to any disclaimer, the term of this patent is extended or adjusted under 35 U.S.C. 154(b) by 0 days.

(21) Appl. No.: 15/315,079

(22) PCT Filed: Jul. 20, 2015

(86) PCT No.: PCT/EP2015/066546

§ 371 (c)(1),
(2) Date: Nov. 30, 2016

(87) PCT Pub. No.: WO2016/016035

PCT Pub. Date: Feb. 4, 2016

(65) Prior Publication Data

US 2017/0198366 A1 Jul. 13, 2017

(30) Foreign Application Priority Data

Jul. 30, 2014 (DE) ..... 10 2014 110 826

(51) Int. Cl.
*B22D 29/00* (2006.01)
*B22D 30/00* (2006.01)
(Continued)

(52) U.S. Cl.
CPC ..... *C21D 9/0068* (2013.01); *B22C 9/02* (2013.01); *B22C 9/046* (2013.01); *B22C 9/10* (2013.01);
(Continued)

(58) Field of Classification Search
CPC ..... B22D 29/00; B22D 30/00; B22D 45/00; B22D 29/003; B22D 45/005; B22C 9/04; B22C 9/10; B22C 9/046; B22C 9/108
(Continued)

(56) References Cited

U.S. PATENT DOCUMENTS 3,815,665 A * 6/1974 Baur ..... B22D 7/10 164/359
4,620,582 A * 11/1986 Muller-Spath ..... B22C 9/00 164/24
(Continued)

FOREIGN PATENT DOCUMENTS

CN 1172760 C 10/2004
CN 1599651 A 3/2005
(Continued)

*Primary Examiner* — Kevin P Kerns
(74) *Attorney, Agent, or Firm* — The Webb Law Firm

(57) ABSTRACT

A method for casting cast parts in which a casting mould is provided. The casting mould is enclosed in a housing, forming a filling space between an inner surface section of the housing and an associated outer surface section of the casting mould. The filling space is then filled with a free-flowing filling material and molten metal is poured in the casting mould. As a consequence a binder of the mould material begins to vaporise and combust disintegrating the casting mould. During the filling of the filling space, the filling material has a minimum temperature, starting out from which the temperature of the filling material rises, to beyond a boundary temperature at which the vaporising binder ignites and combusts.

15 Claims, 4 Drawing Sheets

(51) Int. Cl.

| | |
|---|---|
| ***B22D 45/00*** | (2006.01) |
| ***B22C 9/04*** | (2006.01) |
| ***B22C 9/10*** | (2006.01) |
| ***C21D 9/00*** | (2006.01) |
| ***B22C 9/02*** | (2006.01) |
| *B22C 5/06* | (2006.01) |
| *B22C 5/08* | (2006.01) |

(52) U.S. Cl.
CPC ..... *B22C 9/108* (2013.01); *B22D 29/003* (2013.01); *B22D 30/00* (2013.01); *B22D 45/005* (2013.01); *B22C 5/06* (2013.01); *B22C 5/085* (2013.01)

(58) Field of Classification Search
USPC ..... 164/122, 131
See application file for complete search history.

(56) References Cited

U.S. PATENT DOCUMENTS

| | | | | |
|---|---|---|---|---|
| 5,086,019 | A * | 2/1992 | Weinstein et al. | B28B 7/342 501/127 |
| 6,776,219 | B1 * | 8/2004 | Cornie et al. | B22D 19/14 164/120 |
| 7,870,884 | B2 | 1/2011 | Montero | |
| 2003/0121636 | A1 * | 7/2003 | Gegel et al. | B22C 9/04 164/35 |
| 2005/0145362 | A1 | 7/2005 | Crafton et al. | |
| 2007/0209771 | A1 * | 9/2007 | Makino et al. | B22C 9/03 164/7.2 |
| 2009/0145570 | A1 | 6/2009 | Montero | |
| 2012/0298323 | A1 * | 11/2012 | Thomas et al. | B22F 3/004 164/97 |

FOREIGN PATENT DOCUMENTS

| | | | |
|---|---|---|---|
| DE | 1187768 | | 2/1965 |
| DE | 2044171 | B1 | 10/1971 |
| DE | 19813847 | A1 | 9/1999 |
| DE | 10209183 | A1 | 10/2003 |
| EP | 0546210 | B2 | 7/2003 |
| EP | 0612276 | B2 | 11/2004 |
| JP | 5829566 | A | 2/1983 |
| JP | 1122658 | A | 5/1989 |
| JP | 03465 | A | 1/1991 |
| JP | 2009241137 | A | 10/2009 |
| KR | 1019970005373 | B1 | 4/1997 |
| WO | 0108836 | A1 | 2/2001 |

* cited by examiner

METHOD FOR CASTING CAST PARTS

CROSS-REFERENCE TO RELATED APPLICATIONS

This application is the United States national phase of International Application No. PCT/EP2015/066546 filed Jul. 20, 2015, and claims priority to German Patent Application No. 10 2014 110 826.4 filed Jul. 30, 2014, the disclosures of which are hereby incorporated in their entirety by reference.

BACKGROUND OF THE INVENTION

Field of the Invention

The invention relates to a method for casting cast parts in which a molten metal is poured into a casting mould which encloses a cavity forming the cast part which is to be produced, wherein the casting mould, designed as a lost mould, consists of one or more casting mould parts or cores. The casting mould parts or casting cores are thereby formed of a mould material which consists of a core sand, a binder and, optionally, one or more additives for adjusting particular properties of the mould material.

Description of Related Art

In conventional methods of this kind, the casting mould forming the cast part is usually provided first, the casting cores and mould parts of which have been prefabricated in separate working operations. The casting mould can thereby be composed, as a so-called "core package", of a plurality of casting cores. Equally, it is possible to use casting moulds which are, for example, composed of only two mould halves consisting of mould material, in which the mould cavity forming the cast part is formed, wherein here too mould cores can be present in order to form recesses, cavities, channels and similar in the cast part.

Typical examples of cast parts which are produced by means of a method according to the invention include engine blocks and cylinder heads. For larger engines subject to high loads, these are manufactured of cast iron by means of sand casting.

In the field of iron casting, quartz sands, mixed with bentonites, lustrous carbon formers and water are usually used as mould material for casting mould parts forming the outer closure of the casting mould. The casting cores forming the interior cavities and channels of the cast part are, in contrast, usually formed of commercially available core sands, which are mixed with an organic or inorganic binder, for example with a synthetic resin or water glass.

Irrespective of the type of core sands and binders, the basic principle behind the manufacture of casting moulds formed of mould materials of the aforementioned type is that, after forming, the binder is hardened by means of a suitable thermal or chemical treatment, so that the grains of the core sands adhere together and the stability of form of the relevant mould part or core is ensured over a sufficient duration.

Particularly when casting large-volume cast parts made of cast iron, the internal pressure exerted on the casting mould following the pouring of the molten metal can be very high. In order to absorb this pressure and reliably prevent the casting mould from bursting, either thick-walled large-volume casting moulds must be used or supporting structures must be used which support the casting mould on its outer side.

One possible form of such a supporting structure consists of an enclosure which is placed over the casting mould. The enclosure is usually designed in the form of a jacket which surrounds the casting mould on its peripheral sides but which has on its upper side a sufficiently large opening to allow the melt to be poured into the casting mould. The enclosure is thereby so dimensioned that, after it is placed in position, a filling space remains between the inner surfaces of the enclosure and the outer surfaces of the casting mould, at least in the sections decisive for the support of the casting mould. This filling space is filled with a free-flowing filling material, so that a support of the relevant surface sections over a wide area by the enclosure is guaranteed. In order to ensure as even as possible a filling of the filling space, an equally even contact between the casting mould and the filling material and a correspondingly even support of the fragile mould material, as a rule fine-grained, free-flowing filling materials such as sand or steel shot are used which have a high bulk density. After filling, the filling material is additionally compacted. The aim here is to create the most compact possible filling mass which, acting like an incompressible monolith, ensures the direct transmission of the supporting forces from the enclosure to the casting mould.

The molten metal is poured into the casting mould at a high temperature, so that the casting mould parts and cores of which the casting mould is composed are also heated strongly. Consequently, the casting mould begins to radiate heat. If the temperature of the casting mould exceeds a certain minimum temperature, then the binder of the mould material begins to vaporise and combust, releasing further heat. This causes the binder to lose its effect. As a result of this decomposition of the binder, the cohesion of the grains of the mould material of which the casting mould parts and cores of the casting mould are made is lost and the casting mould and its parts and cores made of mould material collapse into individual fragments.

It is known in practice that this effect can be used for the demoulding of the cast parts from the casting mould. Thus, heat treatment methods for cast parts are for example known from EP 0 546 210 B2 or EP 0 612 276 B2 in which the casting mould together with the cast parts are, in a continuous process sequence, transferred from the casting heat into a heat treatment furnace. While passing through the furnace, the casting mould and the cast parts are exposed over an adequately long duration to a temperature at which the condition of the cast parts is achieved which is the objective of the heat treatment. At the same time, the temperature of the heat treatment is so selected that the binder of the mould material decomposes. The fragments of the casting mould consisting of mould material which then automatically fall away from the cast part are collected in a sand bed in the heat treatment furnace itself. They remain there for a certain period in order to further encourage the disintegration of the fragments of the casting mould parts and cores. The fragmentation of the mould material falling from the casting mould can be supported in that the sand bed is fluidised by blowing in a hot gas flow. The sufficiently disintegrated mould material fragments are finally fed to a processing facility in which the core sand is reclaimed so that it can be used for the manufacture of new casting mould parts and cores.

The known procedure for the demoulding and processing of the casting moulds required for the casting of cast parts has proved effective in practice in the casting, in large quantities, of parts for internal combustion engines made of aluminium. However, this requires a furnace of considerable construction length and a handling of the casting moulds and cast parts which in the case of high-volume parts or casting moulds, requiring additional support through an enclosure of the type described above, proves complicated. This applies in particular to cast parts which are to be manufactured in small and medium-sized quantities from cast iron.

SUMMARY OF THE INVENTION

Against this background, a problem addressed by the invention is providing a method which makes it possible to manufacture cast parts using casting techniques with optimised energy efficiency and in a particularly economical manner. The invention has solved this problem by the method disclosed herein.

Accordingly, the invention provides a method for casting cast parts in which a molten metal is poured into a casting mould which encloses a cavity forming the cast part which is to be produced. The casting mould is designed as a lost mould which consists of one or more casting mould parts or cores. These casting mould parts are in each case formed of a mould material which consists of a core sand, a binder and, optionally, one or more additives for adjusting particular properties of the mould material.

The method according to the invention thereby comprises the following working steps:

- provision of the casting mould;
- enclosure of the casting mould in a housing, forming a filling space between at least one inner surface section of the housing and an associated outer surface section of the casting mould;
- filling the filling space with a free-flowing filling material;
- pouring the molten metal into the casting mould,
  - wherein, as a result of the pouring of the molten metal, the casting mould begins to radiate heat, the consequence of the input of heat caused by the hot molten metal, and
  - wherein, as a consequence of the input of heat caused by the molten metal, the binder of the mould material begins to vaporise and combust, so that it loses its effect and the casting mould disintegrates into fragments.

According to the invention, the filling material poured into the filling space has such a low bulk density that the filling material packing formed by the filling material following filling of the filling space can be permeated by a gas flow.

In addition, in the method according to the invention, during the filling of the filling space the filling material has a minimum temperature, starting out from which the temperature of the filling material rises, as a result of process heat which is generated through the heat radiated from the casting mould and through the heat released during the combustion of the binder, to beyond a boundary temperature of 700° C.

The method according to the invention is thus based on the idea of using the filling material in the sense of a heat accumulator and to design and control the temperature of this heat accumulator such that the binder of the mould material from which the casting mould parts and cores of the casting mould are made is to a very great extent already decomposed during the time spent within the enclosure through the effect of temperature.

In this way, the situation is achieved where the parts and cores of the casting mould consisting of mould material have disintegrated into fragments to the point where these fragments fall away from the cast part and, following removal of the enclosure, the cast part is to a very great extent free of adhering mould parts or cores, at least in the region of its outer surfaces.

At the same time, the cores which form channels or cavities within the interior of the cast part have also fallen away, so that the core sand and the mould material fragments of these cores either already trickle out of the cast part of their own accord in the enclosure or can be removed from the cast part in an essentially known manner, for example through mechanical methods such as agitation, or through flushing with a suitable fluid.

The filling material which, according to the invention, is filled into the filling space formed between the cast part and enclosure is free-flowing, so that it also completely fills the filling space when there are undercuts, cavities and similar present in the region of the outer surfaces of the casting mould.

It is thereby of decisive importance that according to the invention the filling material has a bulk density which is so low that it can be flowed through by a gas flow, also following filling of the filling space and any possible compaction of the filling material filled into the filling space. Thus, according to the invention, in contrast to the aforementioned prior art, an extremely highly compacted packing is expressly not created in the filling space which, while ensuring an optimal support of the casting mould, is to a very large extent impermeable to gas. Rather, the filling material used according to the invention is to be selected such that it is permeable to a gas flow which occurs for example as a result of thermal convection. This occurs when the casting mould is heated through molten metal which has been poured into it and the vaporising binder components of the mould material of the casting mould parts and cores begin to vaporise and combust, releasing heat.

When reference is made here to a vaporising and combusting binder, then this always means those binder components which can vaporise and combust through the application of heat. This does not rule out the possibility of other binder components in solid or other form, for example as crack products, remaining in the casting mould and optimally also being disintegrated there through the influence of heat.

The permeability according to the invention of the filling material filled in the filling space to a gas flow provided for thereby not only makes it possible for the binder vaporising from the casting mould to combust in the region of the filling material itself and in consequence to further heat the filling material, but in addition permits the supply of oxygen, which supports the combustion of the binder. In this way, as a result of the process heat introduced through the molten metal and released through the combustion of the binder, the filling material is heated to a temperature which is so high that the binder components of the mould parts and cores escaping from the casting mould and coming into contact with the filling material combust or are at least so thermally decomposed that they no longer have any environmentally harmful effect or can be drawn out of the enclosure as exhaust gas and can be fed to an exhaust gas purification process.

The filling material, the temperature of which is adjusted beforehand according to the invention, is preferably introduced into the filling space a short time before the pouring of the molten metal in order to minimise temperature losses.

Once a sufficient concentration of combustible gas emissions from the mould material is achieved in the filling space, combustion is initiated through contact with the heated filling material. The combustion of the binder issuing from the casting mould continues and as long as it does so the filling material continues to be heated. This process continues until only such small quantities of binder escape from the casting mould that a combustible atmosphere is no longer formed in the enclosure. However, in the manner of a heat accumulator, the hot filling material now maintains a temperature above the boundary temperature at which combustion of the binder takes place. Accordingly, the casting mould also remains at least at this temperature, so that binder residues remaining in the casting mould are thermally decomposed.

Particularly suitable for the method according to the invention are casting moulds the mould parts and cores of which consist of mould material which is bound together by means of an organic binder. Commercially available binders containing solvents can, for example, be used for this purpose, or binders whose effect is triggered through a chemical reaction. Corresponding binder systems are used today in the so-called "cold box method".

In practice, a temperature of 700° C. is particularly suitable as boundary temperature in the processing of iron casting melt. At above 700° C., organic binders in particular combust reliably. At the same time, at these temperatures other toxic substances which are emitted from the casting mould are oxidised or otherwise made harmless. The same applies to the crack products produced in the casting mould as a consequence of the temperature-related disintegration of the binder, which are also decomposed reliably at such high temperatures.

In that, according to the invention, the filling material is pre-heated to a specific temperature on being filled into the filling space, as a consequence of the input process heat the filling material is heated to a temperature above the boundary temperature. Practical tests have shown here that a temperature of 500° C. is sufficient as the minimum temperature of the filling material on being filled into the filling space.

As the binder leaks out, combusts and decomposes, the parts and cores of the casting mould formed of mould material disintegrate into loose fragments, which can either be disposed of and processed following removal of the enclosure or, advantageously, already be removed from the enclosure during the period between the pouring of the molten metal and the removal of the enclosure. For this purpose, the casting mould can be placed on a sieve base and the fragments of the casting mould which trickle through the sieve base can be collected. For practical purposes, the openings of the sieve base are thereby so designed that the fragments of the casting mould and the filling material trickle together through the sieve base, are collected and processed together and are separated from one another following processing. This has the advantage that no loose filling material is still present in the enclosure when the enclosure is removed.

The enclosure of the casting mould can accordingly be formed through a jacket, consisting of a thermally insulating and sufficiently rigid material, surrounding the casting mould at a distance sufficient for the formation of the filling space, a perforated support plate acting as a sieve plate on which the casting mould is placed, and a cover, also thermally insulating, which is fitted in place following the filling of the casting mould. In order to make possible a controlled extraction of the exhaust gases forming in the filling space, an exhaust gas opening can be provided in addition.

In the method according to the invention too, the filling material filled into the filling space can be compacted in order to create a pre-tension between the casting mould and the enclosure through which a more secure, precisely positioned cohesion of the casting mould is guaranteed, also where the casting mould is formed of a core package consisting of a plurality of mould parts and cores. However, as mentioned, due to the low bulk density, permeability to a gas flow is also ensured even with such a compacted filling.

The effectiveness of the destruction of the mould parts and cores of the casting mould achieved according to the invention can be increased even further in that not only the filling material but also the casting mould itself is designed to be gas-permeable. For this purpose, channels can be deliberately introduced into the casting mould, through which the hot exhaust gas forming in the filling space or appropriately pre-heated oxygen-containing gas flows. In this way, a rapid vaporisation, combustion and other forms of thermal decomposition of the mould material binder is also initiated within the casting mould. This additionally accelerates the disintegration of the casting mould.

Channels deliberately introduced into the casting mould can also be used to accelerate the cooling of specific zones on or in the cast part or to prevent such an accelerated cooling, in order to achieve specific properties of the cast part in the zone in question.

In a filling material according to the invention, following compaction the pre-tension is transmitted through the grains of the filling material which are in contact with one another. In order thereby to prevent the grains of the filling material from being displaced in an uncontrolled manner, despite the gas-permeability of the filling material required according to the invention, the enclosure can be equipped on its inner surface facing the casting mould with a structured surface on which the grains impinging against this surface are, at least in places, supported in a form-locking manner.

The filling material should at the same time have a low suitability for the storage of heat, so that the filling material heats up quickly and can be kept at a temperature above the boundary temperature for as long as possible.

A filling material which is optimally suitable for the purposes of the invention thus combines a low bulk density with a low specific heat capacity of the material of which the individual particles which form the filling material are made. Practical experiments have shown here that filling material in which the product P of bulk density Sd and specific heat capacity cp of the material of which the filling material is made amounts at most to 1 $kJ/dm^3K$ ($P=Sd\times cp\leq 1\ kJ/dm^3K$), whereby filling material in which the product $P=Sd\times cp$ amounts at most to 0.5 $kJ/dm^3K$ is particularly suitable.

Irrespective of whether compaction takes place, granulates or other granular bulk materials have proved effective as filling material. Such bulk materials with bulk densities of max. 4 $kg/dm^3$, in particular less than 1 $kg/dm^3$ or even less than 0.5 $kg/dm^3$, have proved particularly suitable for the purposes of the invention.

If a granular, pourable and free-flowing filling material is used, it has proved favourable in practical tests if the average diameter of the grains is 1.5-100 mm, wherein optimally filling material is used with grain sizes in the region of 1.5-40 mm.

Filling material which consists of materials with a specific heat capacity of max. 1 kJ/kgK, ideally less than 0.5 kJ/kgK, displays a heating and heat storage behaviour which is optimal for the invention.

Fundamentally, all bulk materials are suitable as filling material which can withstand thermal loads, which fulfil the aforementioned conditions and are sufficiently temperature-resistant. Particularly suitable for this purpose are non-metallic bulk materials such as granulates made of ceramic materials. These can be irregularly formed, spherical or contain cavities in order to achieve a good gas flow through the filling material filled in the filling space while at the same time achieving low heat retention properties. The filling material can also consist of annular or polygonal elements which on making contact with one another only touch at certain points, so that sufficient space remains between them to guarantee a good throughflow.

In order to prevent the oxygen-containing gas flow optionally introduced into the enclosure via a gas inlet from cooling the filling material, the gas flow can be heated to a temperature above room temperature before it enters the filling space. Optimally, the temperature of the gas flow is thereby at least at the level of the minimum temperature of the filling material. For example, the hot exhaust gas which is drawn off from the enclosure can be used to heat the gas flow. An essentially known heat exchanger can be used for this purpose. Insofar as a sieve base is provided via which the fragments of the casting mould, possibly together with the filling material, can escape from the enclosure, the oxygen-containing gas flow can also be fed through this sieve base. This not only has the advantage of introducing said gas flow over a wide area, it also has the effect that the infed gas flow is heated through contact with the hot mould material fragments trickling out of the enclosure as well as the equally hot filling material.

Alternatively or in addition, it is also conceivable to mix a partial flow of the exhaust gas flow with the oxygen-containing gas flow and to feed the hot gas mixture obtained in this way back into the filling space. For this purpose, it can be practical for the oxygen-containing gas flow fed into the filling space to consist to 10-90 vol % of exhaust gas.

The oxygen-containing gas flow fed into the filling space can for example consist of ambient air.

The oxygen-containing gas flow fed into the filling space can be sucked into the filling space via a suitably designed inlet as a result of the flow induced within the filling space through heat convection. Alternatively, it is of course equally conceivable to introduce the gas flow into the filling space with a certain pressure by means of a fan or similar.

An optional regulation of the gas flow introduced into the filling space can take place depending on the exhaust gas volume flow issuing from the enclosure in order to prevent the creation of overpressure in the atmosphere prevailing in the filling space. For this purpose, the gas inlet in question can be equipped with a mechanism which controls the air intake depending on the flow velocity. Suitable for this purpose is for example an essentially known pendulum flap which is suspended and loaded in such a way that the flow pressure of the gas flow passing through automatically adjusts the flow velocity and thus the supply of combustion air depending on counterweights.

It is also conceivable to carry out an exhaust gas measurement at the exhaust gas outlet and to regulate the oxygen-containing gas flow depending on the result of this measurement in order to guarantee a complete combustion of the binder and the other gases which may possibly be emitted from the casting mould into the filling space.

A minimisation of the emission of toxic substances can also be achieved in the method according to the invention in that the enclosure is equipped with a catalytic converter for decomposition of toxic substances contained in the combustion products of the binder.

The cast part which is exposed following the demoulding according to the invention can, following the disintegration of the casting mould, undergo a heat treatment in which it is cooled in an essentially known controlled manner according to a specified cooling curve in order to achieve a specific condition of the cast part.

Naturally, in a procedure according to the invention, several casting moulds can be housed together in an enclosure and these casting moulds filled with molten metal, parallel or consecutively, at closely spaced intervals.

Fundamentally, the method according to the invention is suitable for any kind of metallic casting material during the processing of which a sufficiently high process heat is produced. The method according to the invention is particularly suitable for the manufacture of cast parts made of cast iron, because due to the high temperature of the molten cast iron the temperatures required for the combustion of the binder according to the invention are particularly reliably achieved. In particular, GJL, GJS and GJV cast iron materials as well as cast steel can be processed according to the invention.

When reference is made here to the casting mould used according to the invention consisting of mould parts or cores which are formed of mould material, this naturally includes the possibility of manufacturing individual parts, such as chills, supports and similar, within such a casting mould, of other materials. The only decisive requirement is that the casting mould contains such a volume of mould material that, during the course of pouring the molten metal in question, binder vaporises out and then combusts in the filling space and heats up the filling material to the extent that it maintains a temperature above the boundary temperature for a period sufficiently long to ensure a virtually complete decomposition of the binder of the mould material.

The cleaning of the exhaust gas flow issuing from the enclosure provided according to the invention can be achieved in that the combustible substances still present in the exhaust gas are subsequently combusted in an exhaust air combustion process. The heat thereby released can in turn be used in order to pre-heat the oxygen-containing gas flow fed into the enclosure.

Insofar as cast pieces are created, in the way described according to the invention, with several casting moulds according to the invention arranged in parallel, then it can be practical if the casting moulds, together with the associated enclosures, are arranged together in a tunnel or similar and the exhaust gases which are formed are extracted in a common exhaust gas pipe.

The method according to the invention is suitable in particular for the manufacture by casting of engine blocks and cylinder heads for internal combustion engines. In particular, where the components in question are intended for commercial vehicles, they, and the casting mould required for their manufacture, have a comparatively large volume, in which cases the advantages of the procedure according to the invention are particularly clearly manifested.

As a rule, when they emerge from the enclosure, the core sand fragments obtained according to the invention are still so hot that they can be pulverised in a conventional crushing mill without the supply of additional heat. If the core sand fragments are present in the form of a mixture with the filling material, then they are separated following crushing. This is very simple, because the grain size of the core sand obtained following crushing is very much smaller than the grain size of the filling material. The crushing mill can thereby be so designed that it effects a mechanical preconditioning of the core sand. Such a preconditioning can for example consist in that the surface roughness of the grains of sand increases through the contact of the core sand with the filling material granulate and thus, during the subsequent processing to form a mould part or core, the adhesion of the binder to the core sand is improved.

The recycled sand obtained following processing can be mixed with new sand in an essentially known manner.

BRIEF DESCRIPTION OF THE DRAWINGS

The invention is explained in more detail in the following with reference to a drawing representing, in diagrammatic form, an exemplary embodiment, wherein.

DESCRIPTION OF THE INVENTION

Figure 1:
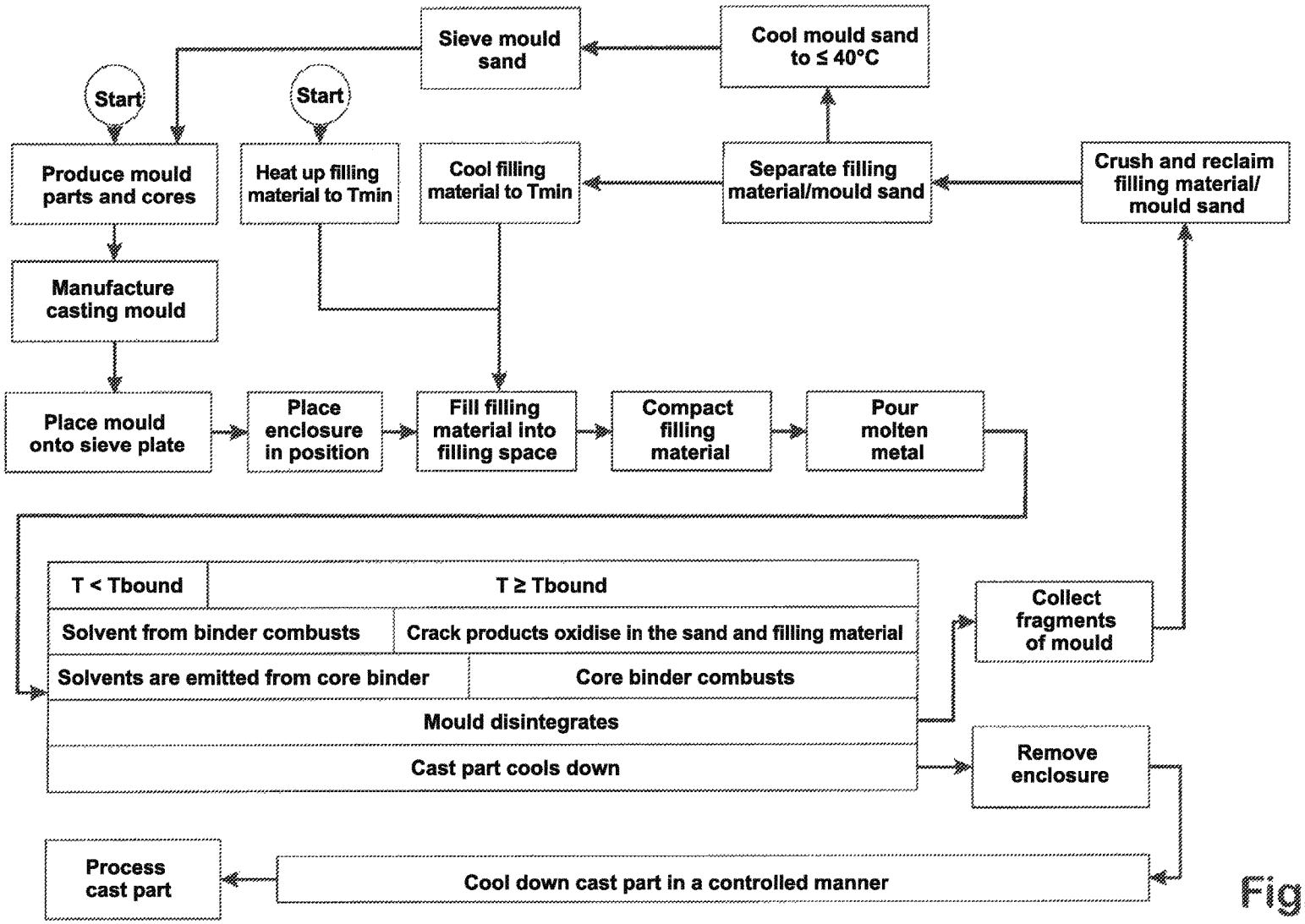
FIG. 1 shows a flow chart representing the process according to the invention.
Figure 2:
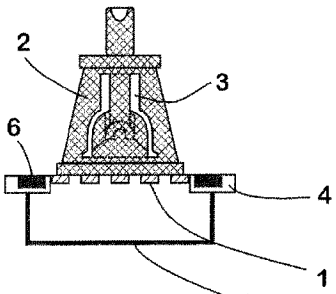
FIGS. 2-8 show a thermoreactor in different phases of the performance of the method according to the invention, in each case viewed as a section along its longitudinal axis.

FIG. 1 shows in diagrammatic form the cycle involved in carrying out the method according to the invention. This starts with casting mould parts and cores made of mould material which consists of a mixture of new, unused core sand, for example quartz sand, and a conventional binder, for example a commercially available cold box-binder. New filling material, for example ceramic granulate with an average grain size of 1.5-25 mm, is also used which, for its first use, must be heated to the required minimum temperature, for example 500° C., before it can be used. These starting materials can later be reused in the cycle, as explained below.

The thermoreactor T, represented in different phases of the method according to the invention in FIGS. 2-8, has a sieve plate 1, on which a casting mould 2 prepared for pouring a cast iron melt is placed. The casting mould 2 is intended for the manufacture by casting of a cast part G, which in the present example is an engine block for an internal combustion engine of a commercial vehicle.

The casting mould 2 is assembled in a conventional manner as a core package consisting of a plurality of outer cores or mould parts arranged on the outside and casting cores arranged on the inside. In addition, the casting mould 2 can include components consisting of steel or other indestructible materials. These include for example chills and similar which are arranged in the casting mould 2 in order to achieve a controlled solidification of the cast part G through an accelerated solidification of the melt coming into contact with the chill.

The casting mould 2 delimits from the environment U a mould cavity 3 into which the cast iron melt is poured in order to form the cast part G. The iron melt thereby flows into the mould cavity 3 via a gate system, which for reasons of clarity is not shown here.

The cores and mould parts of the casting mould 2 are manufactured, in a conventional manner using the cold box method, from a conventional mould material consisting of a mixture of a commercially available core sand, a commercially available organic binder and optionally added additives, which for example serve the purpose of allowing better wetting of the grains of the core sand through the binder. The casting cores and mould parts of the casting mould 2 are formed from the mould material. The obtained casting cores and mould parts are then gassed with a reaction gas in order to harden the binder through a chemical reaction and thus lend the cores and mould parts the necessary rigidity.

The edge of the sieve plate 1 is supported on a peripheral edge shoulder 4 of a collecting pan 5. A sealing element 6 is integrated in the peripheral contact surface of the edge shoulder 4.

Figure 3:
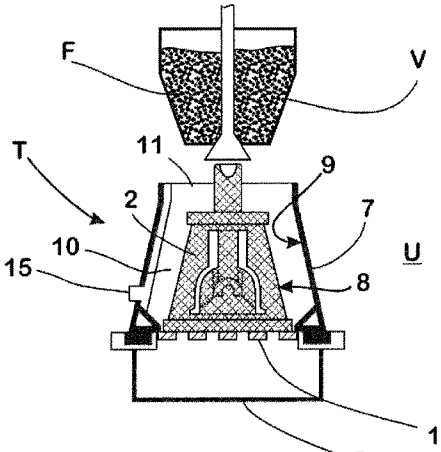

Once the casting mould 2 is positioned on the sieve plate 1, an enclosure 7, which is also part of the thermoreactor T, is placed on the peripheral edge shoulder 4 of the collecting pan 5. The enclosure 7 is designed in the form of a hood and encases the casting mould 2 on its outer peripheral surfaces 8. The periphery of the space bounded by the enclosure 7 is over-dimensioned in comparison with the periphery of the casting mould 2, so that after the enclosure 7 is placed on the sieve base 1 a filling space 10 is formed between the outer peripheral surface of the casting mould 2 and the inner surface 9 of the enclosure 7. The enclosure rests on the sealing element 6 with its edge associated with the collecting pan 5, so that a tight seal of the filling space 10 with respect to the environment U is guaranteed. The enclosure consists of a thermally insulating material, which can consist of several layers, of which one layer guarantees the necessary stability of form of the enclosure 7 and another layer guarantees thermal insulation. On its upper side, the enclosure 7 surrounds a large opening 11 via which the casting mould 2 can be filled with cast iron melt and the filling space 10 with filling material F (FIG. 3).

Figure 4:
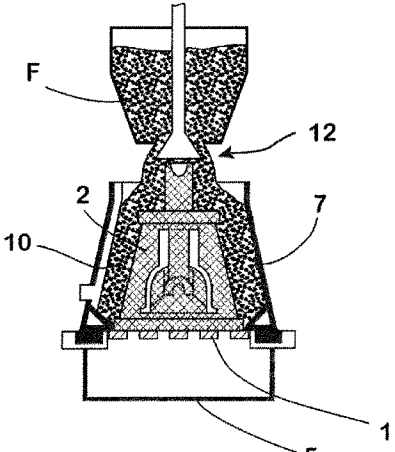

In order to fill the filling space 10 with a filling material F in the form of a granulate, heated to a temperature Tmin of at least 500° C., a storage hopper V is positioned above the opening 11 from which the hot filling material F is then allowed to trickle into the filling space 10 via a distribution system 12 (FIG. 4).

Figure 5:
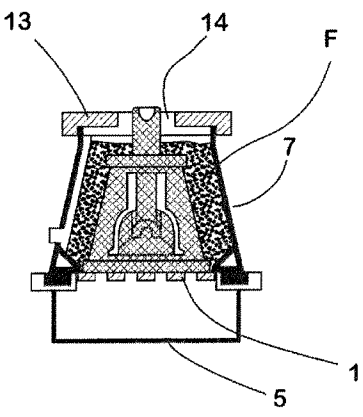

When the filling process is completed, the material packing filled into the filling space 10 can be compressed if necessary. A cover 13 is then placed on the opening 11, which also has an opening 14 via which the cast iron melt can be filled into the casting mould 2 (FIG. 5).

Figure 6:
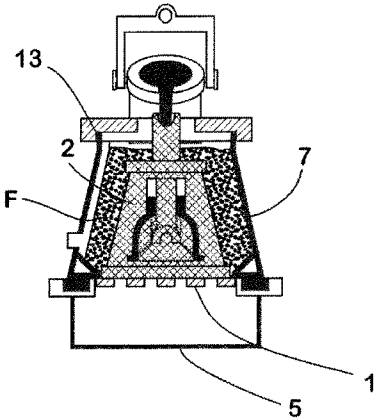

The cast iron melt is then poured into the casting mould 2 (FIG. 6).

Figure 7:
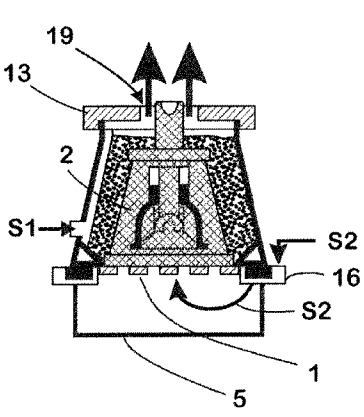

Meanwhile, oxygen-containing ambient air can enter the filling space 10 via a gas inlet 15 moulded into the lower edge region of the enclosure 7. Ambient air which enters the collecting pan 5 via an access 16 is also sucked into the filling space 10 via the sieve base 1 (FIG. 7).

The desired destruction of the casting mould 2 which commences with the pouring of the cast iron melt and the associated demoulding of the cast part G takes place in two phases.

In the first phase, solvent in the binder evaporates. The solvent emitted from the casting mould 2 in vapour form reaches a concentration in the filling space 10 at which it automatically ignites and burns off. As a result of the heat thus released, the granular filling material F, which has been brought to a temperature Tmin of approx. 500° C. is heated to above the boundary temperature Tbound of 700° C. until its temperature reaches the maximum temperature Tmax of approximately 900° C.

When the concentration of the binder components evaporating from the casting mould 2 is no longer sufficient for an autonomous combustion, the filling material heated in this way assumes the function of a heat accumulator, through which the temperature of the casting mould 2 and that in the filling space 10 is maintained at a level above a temperature Tbound of 700° C. In this way, the combustion of the binder components and other potential toxic substances issuing from the casting mould 2 continues until no more binder evaporates from the casting mould 2. As a result of the high temperature prevailing within the filling space 10, the vaporous substances which may still be issuing from the casting mould 2 are oxidised or otherwise rendered harmless.

The oxygen-containing gas flows S1, S2 formed of ambient air which enter the filling space 10 of the enclosure 7 via the gas inlet 15 and the sieve base 1 also contribute to the completeness of the combustion of the gases issuing from the casting mould 2.

Since the bulk density of the filling material F is so low that a good gas permeability of the filling material packing present in the filling space 10 is guaranteed even following compaction, a good intermixture of the gases issuing from the casting mould 2 with the gas flows S1, S2 supplying oxygen for their combustion is guaranteed. At the same time the filling material packing in the filling space 10 supports the casting mould 2 on its peripheral surfaces and in this way prevents the cast iron melt from breaking through.

The flow of the gases issuing from the casting mould 2 through the filling material F causes a good intermixture with the infed gas flow S1, S2, a longer process time and a good reactivity. The casting mould 2 is heated up both through the combustion of the binder system and the heat input through the metal poured into the casting mould 2, as well as through the pre-heated filling material F. As a consequence, the binder system holding together the mould parts and cores of the casting mould 2 is virtually completely destroyed. The mould parts and cores then disintegrate into fragments B or individual grains of sand.

Figures 8, 9, 10, 11, 12, 13, 14, 15:
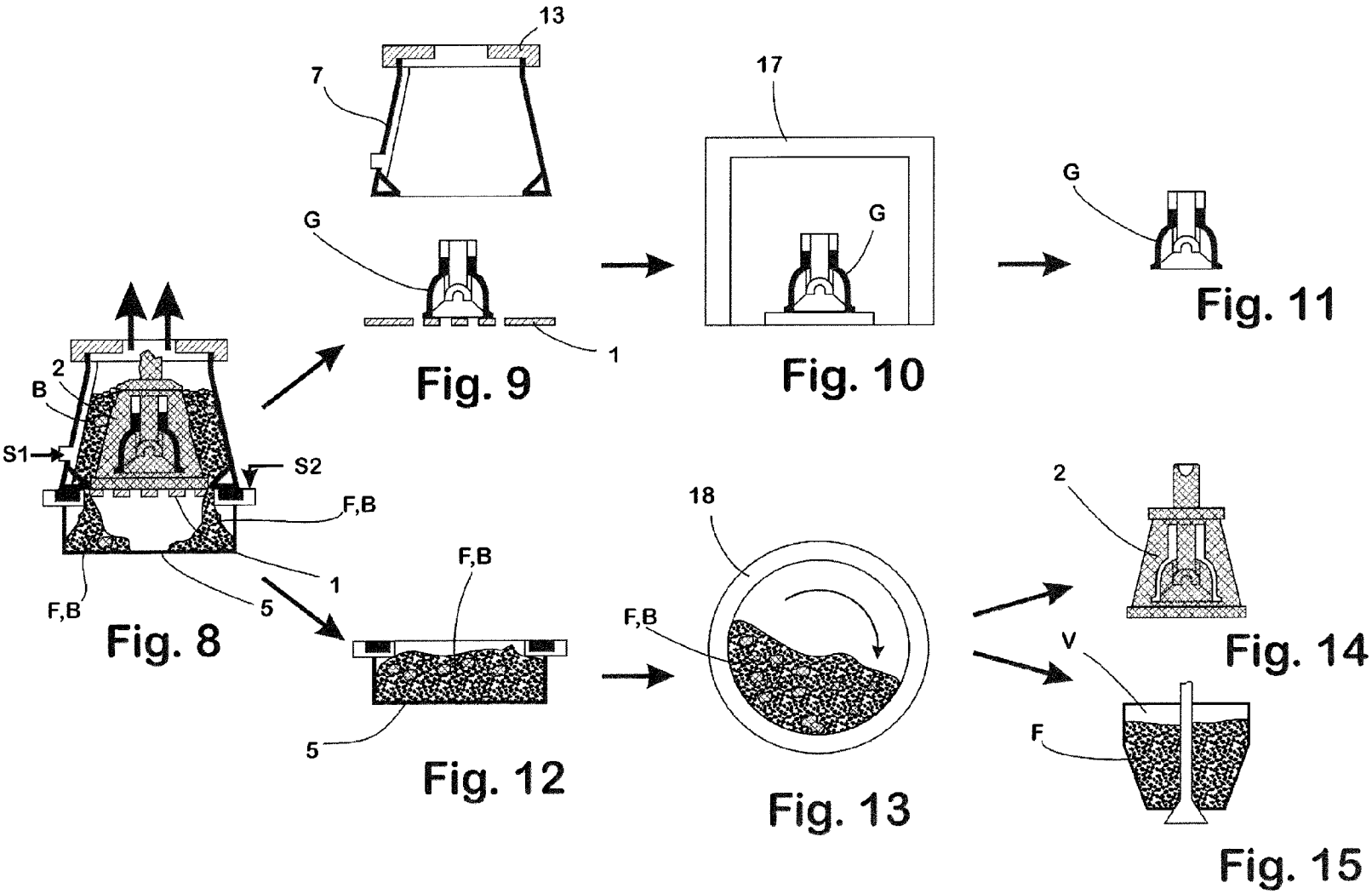
FIG. 9 shows the thermoreactor opened for removal of the cast parts in a view corresponding to FIGS. 2-8.
FIG. 10 shows an apparatus for cooling down a cast part.
FIG. 11 shows the finished cast part.
FIG. 12 shows a collecting pan of the thermoreactor in a view corresponding to FIGS. 2-8.
FIG. 13 shows a crushing mill for regenerating core sand in a section transverse to its longitudinal axis.
FIG. 14 shows a casting mould for casting a cast part in a view corresponding to FIGS. 2-8.
FIG. 15 shows a storage hopper filled with filling material in a view corresponding to FIGS. 2-8.

The fragments B and the loose sand fall through the sieve base 1 into the collecting pan 5 and are collected there. Depending on the progress of the destruction of the casting mould 2, the sieve base 1 can thereby be opened so that filling material F also falls into the collecting pan 5 (FIG. 8).

In order to achieve optimal combustion of the gases issuing from the casting mould 2 and for the regeneration of the core sand already in the enclosure, the temperatures of filling material F and the gases flowing into the filling space 10 are, optimally, in each case well above 700° C. For this purpose, the conditions within the thermoreactor T are such that the regeneration process and the exhaust gas treatment proceed independently of plant availability. Determining and set values are the start temperature of the filling material F, the oxygen-containing gas flows S1, S2 flowing in via the gas inlet 15 and the intake 16 and the casting mould 2 itself.

The progress of the destruction of the casting mould 2 and the progress of solidification of the cast iron melt poured into the casting mould 2 are matched to one another such that the cast part G is sufficiently solidified when the disintegration of the casting mould 2 begins.

Once the casting mould 2 has substantially disintegrated completely, the collecting pan 5 with the mould material-filling material mixture contained therein is separated from the sieve base 1 and the enclosure 7 is also removed from the sieve base 1. The largely de-sanded cast part G is now freely accessible and can be cooled down in a controlled manner in a tunnel-like space 17 provided for this purpose (FIG. 10). On being removed, the cast part G is at a high temperature at which the austenite transformation has not yet been completed and a rapid cooling would lead to internal stresses and thus to cracks. For this reason, the cast part G is cooled down slowly in a cooling tunnel 17 according to the annealing curves for stress-free annealing. The supply of cooling air is so dimensioned that the cooling profile is achieved on a product-specific basis.

The still-hot mixture of filling material F, core sand and fragments B contained in the collecting pan 5 is intensively mixed in a crushing mill 18, which can for example be a rotary mill, and mixed with sufficient oxidation air so that any binder residues which may still be present subsequently combust. In this process stage, the filling material F can also be separated from the core sand and both passed to a separate cooling stage. Such a regeneration reliably guarantees complete combustion of the binder system and in addition, through mechanical friction, prepares the core sand surface for a good adhesion of the binder for re-use as core sand.

The obtained core sand is cooled virtually to room temperature and, following separation of the fractions, once again processed into casting mould parts or casting cores for a new casting mould 2.

The filling material F is in contrast cooled to the intended starting temperature Tmin and, as part of the cycle, filled into the storage hopper V for renewed filling of the filling space 10.

The quantity of the combustion air introduced into the filling space 10 as gas flows S1, S2 is regulated by means of mechanically adjustable flaps or slide valves with which the opening cross sections of the gas inlet 15 and of the intake 16 can be adjusted. The relevant adjustment can first be determined through the quantity of air stoichiometrically necessary for combustion of the binder system and then finely adjusted by means of measurements of CO, NOx and O2 at the exhaust gas outlet 19, formed in this case by the opening 14 of the cover 13 which is moulded into the cover 13 and via which the exhaust gases produced in the filling space 10 are extracted from the enclosure 7.

Figure 16:
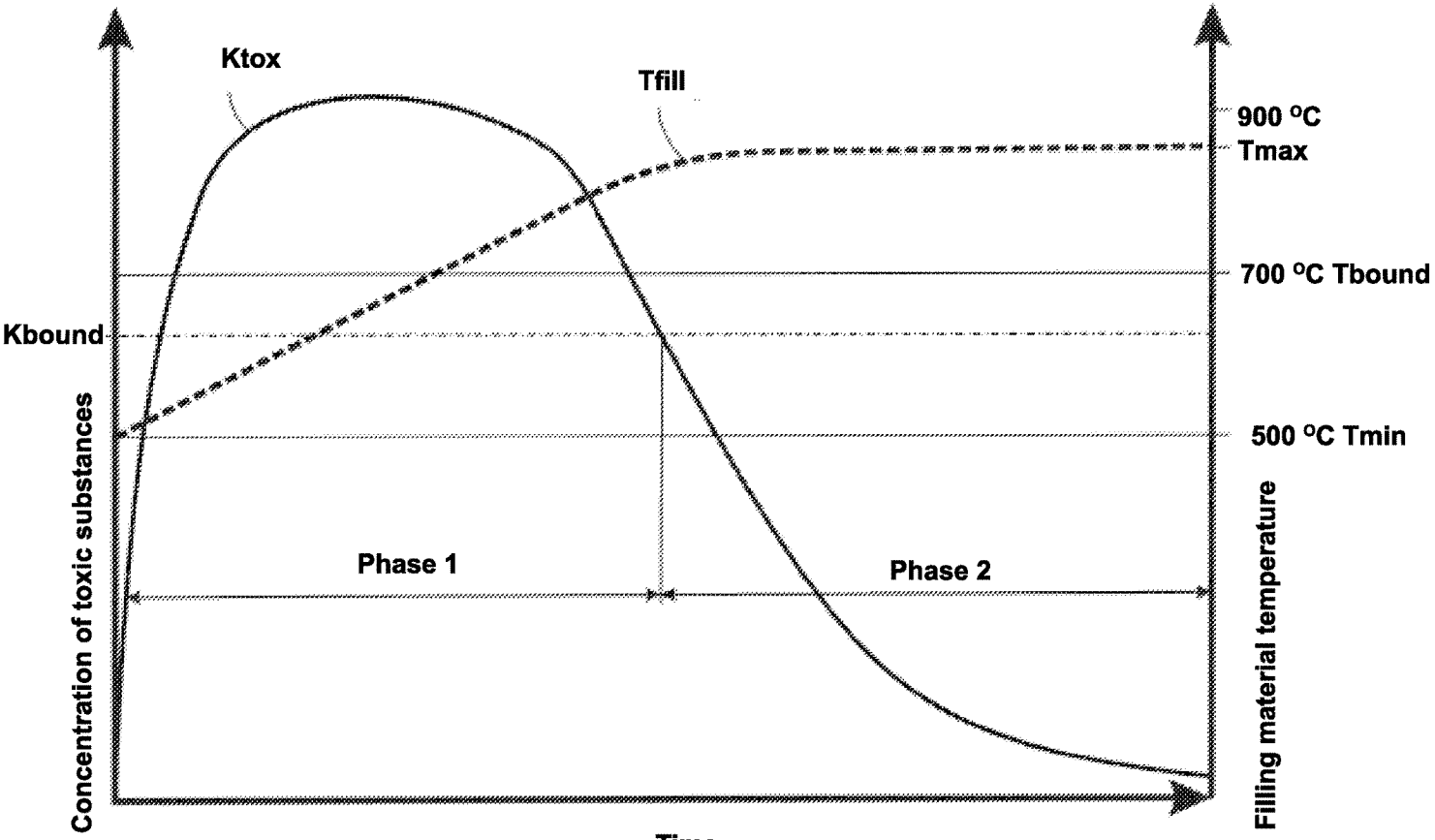
FIG. 16 is a graph showing the relationship between the concentration of toxic substances in the filling space and the temperature of the granulate as a function of time during the inventive method.

As can be seen from FIG. 16, a high toxic substance concentration represented by the curve Ktox is reached in the filling space 10 immediately following pouring, through the evaporation of the solvent from the binder system of the casting mould 2 and the other vaporous emissions from the casting mould 2, which would combust autonomously even at room temperatures. The boundary Kbound, from which a toxic substance concentration is reached which is combustible at room temperature, is indicated in FIG. 16 through the dotted line. However, due to the high minimum temperature Tmin of 500° C., which prevails in the filling space 10 due to the hot filling material F which has been introduced there, the combustion of the gases entering the filling space 10 from the casting mould 2 already begins at a significantly lower concentration (see FIG. 16).

As a result of the combustion within the granulate in phase 1, the granulate heats up and after a short time its temperature Tfill exceeds the boundary temperature Tbound of 700° C., at which, given a sufficient oxygen content, organic substances are known to oxidise and thus combust autonomously. The curve of the temperature Tfill is shown in FIG. 16 as a broken line.

This phase ("phase 1") of intensive combustion of the binder evaporating from the casting mould 2 continues until the concentration Ktox of the combustible gases escaping into the filling space 10 from the casting mould 2, substantially formed by the evaporating binder, reduces to such an extent that no further combustion would take place at room temperature.

However, as already described, due to the high filling material temperature of more than 700° C., this oxidation or combustion is continued in the following phase 2, wherein which the heat thereby released is sufficient to further increase the temperature of the filling material 10 until the maximum temperature Tmax is reached. The filling material 10 remains at this temperature until the decomposition process of the casting mould 2 is so advanced that no further significant vapour emissions take place, the casting mould 2 disintegrates into small parts and the mould material remnants fall into the pan 5. However, as long as combustion processes take place in the filling space 10, so much heat is still thereby generated that the filling material F remains over a sufficiently long period within a range the upper limit of which is the temperature Tmax and the lower limit the temperature Tbound.

Thus, according to the invention, through the selection of the temperature at which the filling material F is filled into the filling space 10, the time at which the boundary temperature Tbound of 700° C. is exceeded is so defined that this is achieved before, as a result of low toxic substance concentrations Ktox, the process of combustion in the filling space 10 no longer reliably takes place with the necessary intensity. The still highly heated filling material F then ensures that the decomposition and residual combustion of the gases still issuing from the casting mould 2 takes place, even if the concentration of combustible gases present in the filling space, considered in themselves, would be too low for this at temperatures below the temperature Tbound.

It has been proved that, with the evaporating and combustible substances contained in the casting mould 2, so much chemical energy is available for a combustion that filling material temperatures of well above 1,000° C. could be achieved. However, in this case the cooling of the cast piece would be drawn out over a long time, so that long process times would be necessary. This too can be determined through the start temperature with which the filling material F is filled into the filling space 10. Too sharp a rise in temperature can also be prevented through an increase in the gas flows S1, S2, in this case acting as cooling air.

In choosing the filling material F, which is for example ceramic filling material, it is ensured that the individual grains of the filling material F possess a high compressive strength in order to absorb the compressive forces occurring during casting and to minimise friction losses as far as possible during circulation. A further selection criterion is a low heat capacity in combination with the bulk density of the filling material F, in order, from phase 1, to achieve a temperature rise above the 700° C. as quickly as possible. A formation of nitrogen oxide is largely prevented through the oxidation in the bulk material with an adjusted supply of combustion air and relatively low temperature.

Since according to the invention the output exhaust gases substantially heat up the filling material packing even in the first phase, a temperature profile results within the packing which guarantees clean combustion. Due to the thermal convection flow created in the filling space 10, the combustion air flows upwards in a vertical direction and, due to the pronounced vapour formation in the first phase, the emission of the gaseous toxic substances from the casting mould 2 into the filling material packing takes place in a horizontal direction. The intersection of the gas flows within the filling material F guarantees a good intermixture.

In the region above the casting mould 2, the gas flows then follow the same direction and can post-combust sufficiently in the hottest region of the exhaust gas conduit in the combustion space between the cover 13 and filling material F before exiting from the exhaust gas outlet 19 above the pouring funnel.

In an example calculation, the thermal energy Qa released through the cooling of the melt and the combustion of the binder as well as the thermal energy Qb required for the heating of the filling material as well as the heating of the core sand of the casting mould are determined on the basis of the parameters and material values stated in Table 1 for a process according to the invention.

It has thereby been assumed that, as melt, a grey cast iron melt is poured into a casting mould the mould parts and cores of which are manufactured, using the conventional cold box method, of mould material which consists of conventional core sand, i.e. quartz sand, and a binder which is also commercially available for this purpose.

Moreover, for the purpose of simplification it has been assumed that the cast metal gives off its heat to the casting mould and the filling material after casting and that the chemical energy latent in the binder used is completely available for heating of the filling material in the form of combustion heat.

The fusion heat Hfus which needs to be conducted away in order to solidify the melt is then calculated according to the formula $$\text{Hfus}=m_{melt}\times\text{hfus}\times 1/1000\ \text{MJ/kJ}$$

thus, in the present example $$\text{Hfus}=170\text{kg}\times 96\text{kJ/kg}\times 1/1000\ \text{MJ/kJ}=16.3\text{MJ}.$$

The thermal energy Qa1 released from the melt as it cools is then calculated according to the formula $$\text{Qa1}=\text{cp}\times\Delta T\times m\times 1/1000\ \text{MJ/kJ}-\text{Hfus}$$

where, in the present example, $$\Delta T=(T1-T2)=(850\text{K}-1500\text{K})=-650\text{K as Qa1}=950\ \text{J/kgK}\times -650\text{K}\times 170\text{kg}\times 1/1000\ \text{MJ/kJ}\ -16.3\text{MJ}$$

$$\text{Qa1}=-121\ \text{MJ}.$$

In a corresponding calculation, the thermal energy Qa2 released through the combustion of the binder contained in the mould material is calculated, according to the formula $$\text{Qa2}=\text{hi}\times m_{Binder}\times \qquad (-1)$$

as $$\text{Qa2}=30\ \text{MJ/kg}\times 4\ \text{kg}\times(-1)=-120\ \text{MJ}.$$

The total of the released thermal energy Qa=Qa1+Qa2 then amounts to −241 MJ.

The thermal energy Qb1 required for the heating of the core sand of the casting mould from the temperature T1 to the temperature T2 is calculated according to the formula $$\text{Qb1}=\text{cp}_{core\ sand}\times(\text{T2}-\text{T1})\times\text{encore sand}$$

as $$\text{Qb1}=835\ \text{J/kgK}\times(800\text{K}-20\text{K})\times 255\ \text{kg}=166\ [\text{MJ}].$$

Again, the thermal energy Qb2 for the heating of the core sand of the casting mould from the temperature T1 to the temperature T2 is calculated according to the formula $$\text{Qb2}=\text{cp}_{filling\ material}\times(\text{T2}-\text{T1})\times m_{filling\ material}$$

as $$\text{Qb2}=754\ \text{J/kgK}\times(800\text{K}-500\text{K})\times 125\ \text{kg}=28\ [\text{MJ}].$$

The heat Qb=Qb1+Qb2 required in order to heat the core sand of the casting mould, initially still at the room temperature of 20° C., and the filling material filled with the temperature T1 of 500° C. to the final temperature T2 of 800° C. then amounts in total to Qb=166 MJ+28 MJ=194 MJ.

Accordingly, with the parameters stated in Table 1, as a result of the heat input through the melt and the combustion of the binder emitted from the casting mould, an energy surplus of 47 MJ is available for heating of the filling material F and for the compensation of tolerances and losses.

The determination of an energy balance achievable on pouring a grey cast iron melt reproduced in Table 1 shows that, using a conventional mould material produced on the basis of a conventional binder system and using quartz sand, a clear surplus capacity of thermal energy is present. The infed oxygen-containing gas flows S1, S2 are disregarded in this consideration, since their influence in energy terms is very slight.

In Table 2, the bulk densities Sd, the specific heat capacities cp and the product P=Sd×cp are stated for different bulk materials which in terms of their temperature-resistance would be fundamentally suitable for use as filling material. It can be seen that, for example, steel shot, while having a significantly lower specific heat capacity cp than a ceramic granulate of the kind referred to here, has much too high a bulk density to guarantee the gas permeability of the filling material packing provided in the filling space around the casting mould which is required according to the invention.

REFERENCE NUMBERS

1 sieve plate
2 casting mould
3 mould cavity
4 peripheral edge shoulder
5 collecting pan
6 sealing element
7 enclosure (housing)
8 peripheral surfaces of the casting mould 2
9 inner surface of the enclosure 7
10 filling space
11 opening of the enclosure
12 distribution system
13 cover
14 opening of the cover 13
15 gas inlet
16 intake
17 cooling tunnel
18 crushing mill
19 exhaust gas outlet
B fragments
F filling material
G cast part
S1, S2 oxygen-containing gas flows
T thermoreactor
U environment
V storage hopper

TABLE 1

| Material value/ parameter | | Filling material Ceramic granulate | Core sand Quartz sand | Cast metal Grey cast iron | Binder Cold box binder | Unit |
|---|---|---|---|---|---|---|
| Melting enthalpy | hfus | | | 96 | | kJ/kg |
| Heat capacity at 800° C. | cp | 754 | 835 | 950 | | J/kg/K |
| Calorific value | hi | | | | 30 | MJ/kg |
| Mass | m | 125 | 255 | 170 | 4 | kg |
| Input temperature | T1 | 500 | 20 | 1500 | | ° C. |
| Output temperature | T2 | 800 | 800 | 850 | | ° C. |

TABLE 2

| Filling material | Bulk density Sd [kg/dm$^3$] | Specific heat capacity cp [J/kgK] | P = Sd × cp |
|---|---|---|---|
| Ceramic material | 0.61 | 754 | 460 |
| Steel shot | 4.20 | 470 | 1,974 |
| Quartz sand | 1.40 | 835 | 1,169 |

The invention claimed is:

1. A method for casting a cast part, in which a molten metal is poured into a casting mould which encloses a cavity forming the cast part which is to be produced, wherein the casting mould, designed as a lost mould, includes one or more casting mould parts or cores which are formed of a mould material which includes a core sand, a binder and, optionally, one or more additives for adjusting particular properties of the mould material, the method comprising the following working steps:

providing the casting mould;

enclosing the casting mould in a housing forming a filling space between at least one inner surface section of the housing and an associated outer surface section of the casting mould;

filling the filling space with a free-flowing filling material; and pouring molten metal into the casting mould, wherein, as a result of the pouring of the molten metal, the casting mould begins to radiate heat, the consequence of the input of heat caused by the hot molten metal, wherein, as a consequence of the input of heat caused by the molten metal, the binder of the mould material begins to vaporise and combust, so that it loses its effect and the casting mould disintegrates into fragments;

wherein the filling material poured into the filling space has such a low bulk density that the filling material packing formed by the filling material following filling of the filling space is permeated by a gas flow and wherein, on filling the filling space, the filling material has a minimum temperature starting out from which the temperature of the filling material rises as a result of process heat which is generated through the heat radiated from the casting mould and through the heat released during combustion of the binder, to above a boundary temperature at which the binder evaporating from the casting mould and coming into contact with the filling material ignites and begins to combust.

2. The method according to claim 1, wherein a product of bulk density and specific heat capacity amounts to a maximum of 1 $kJ/dm^3K$.

3. The method according to claim 1, wherein the bulk density amounts to a maximum of 4 $kg/dm^3$.

4. The method according to claim 1, wherein the filling material possesses a maximum specific heat capacity of 1 kJ/kgK.

5. The method according to claim 1, wherein the filling material is formed of granules with an average diameter between 1.5-100 mm.

6. The method according to claim 1, wherein the temperature of the filling material during filling of the filling space is at least 500° C.

7. The method according to claim 1, wherein the boundary temperature is 700° C.

8. The method according to claim 7, wherein the gas flow is heated to a temperature above room temperature.

9. The method according to claim 1, wherein the housing has a gas inlet and an exhaust gas outlet and wherein the filling material contained in the filling space is, at least at times and in certain sections, flowed through by an oxygen-containing gas flow.

10. The method according to claim 8, wherein the gas flow is regulated depending on exhaust gas volume flow issuing from the exhaust gas outlet.

11. The method according to claim 8, wherein an exhaust gas measurement is carried out at the exhaust gas outlet and wherein the gas flow is regulated depending on a result of this measurement.

12. The method according to claim 8, wherein a partial flow of combustion gases issuing from the exhaust gas outlet is mixed with the oxygen-containing gas flow and the resulting mixture is fed into the housing.

13. The method according to claim 1, wherein the housing is equipped with a catalytic converter for decomposing toxic substances contained in combustion products of the binder.

14. The method according to claim 1, wherein the casting mould is placed on a sieve base, and wherein the fragments of the casting mould and the filling material trickle together through the sieve base, are collected and processed together and are separated from one another following processing.

15. The method according to claim 1, wherein, following disintegration of the casting mould, the cast part passes through a heat treatment during which it is cooled in a controlled manner according to a specified cooling curve.

* * * * *